US005577832A

United States Patent [19]

Lodhie

[11] Patent Number: 5,577,832

[45] Date of Patent: Nov. 26, 1996

[54] MULTILAYER LED ASSEMBLY

[76] Inventor: Pervaiz Lodhie, 14 San Clemente, Ranchos Palos Verdes, Calif. 90275

[21] Appl. No.: 558,463

[22] Filed: Nov. 16, 1995

Related U.S. Application Data

[63] Continuation of Ser. No. 378,735, Jan. 26, 1995, abandoned.

[51] Int. Cl.[6] ..... F21V 21/00

[52] U.S. Cl. ..... 362/249; 362/800; 362/252; 362/294; 362/457

[58] Field of Search ..... 362/800, 249, 362/235, 252, 240, 294, 373, 250, 457, 226

[56] References Cited

U.S. PATENT DOCUMENTS

| | | | |
|---|---|---|---|
| 4,965,457 | 10/1990 | Wrobel et al. | 362/249 |
| 5,160,201 | 11/1992 | Wrobel | 362/800 X |
| 5,303,124 | 4/1994 | Wrobel | 362/20 |
| 5,390,092 | 2/1995 | Lin | 362/800 X |
| 5,400,228 | 3/1995 | Kao | 362/800 X |
| 5,410,453 | 4/1995 | Ruskouski | 362/249 X |

*Primary Examiner*—Stephen F. Husar
*Assistant Examiner*—Thomas M. Sember
*Attorney, Agent, or Firm*—Blakely Sokoloff Taylor & Zafman

[57] ABSTRACT

A multi-layer LED assembly which is used as a replacement light for equipment used in manufacturing environments. On each layer of the multi-layer assembly, there are multiple LEDs which are mounted perpendicular to a base. The base is used to provide electrical and mechanical connection to a socket. The LED assembly is constructed in a manner which allows the LED assembly to be inserted into a socket of a lighting fixture and then mechanical and electrical connections are provided without requiring rotation of the LED assembly. Electrical connection is by permanently attached wires between the base and the LEDs. The base is rotatable within a predetermined angular range which is sufficient to provide a proper mechanical and electrical connection without putting strain on the permanently attached electrical wires. The LED assembly may utilize multiple layers of LEDs, with each layer itself having multiple LEDs. The LEDs in each layer are mounted in a direction perpendicular to the base which results in light emanating in a direction perpendicular to the base.

19 Claims, 3 Drawing Sheets

MULTILAYER LED ASSEMBLY

This is a continuation of application Ser. No. 08/378,735 filed Jan. 26, 1995, now abandoned.

BACKGROUND OF THE INVENTION

In general, replacement lights when they are installed in existing fixtures, must be rotated in order for there to be a secure mechanical fit and/or electrical connection. However, certain fixtures such as XVA Light Module sold by Square D Company are not suitable for installation of replacement lights which must be rotated to provide mechanical and/or electrical contact due to close tolerances and/or lack of easy access. Frequently, in such situations, in order for lights to be replaced, entire panels and other structures need to be removed in order to obtain access to sockets in to which the replacement lights are to be inserted. Additionally, in existing lighting units, which usually use an incandescent light source, the lighting element or elements throw off light about an angle of approximately 270° around the base of the replacement light. However, in certain environments, such as manufacturing assembly lines, it is desirable that light be thrown off in a direction which is generally perpendicular to the base of the lighting element.

U.S. Pat. No. 5,303,124 teaches a light emitting diode (LED) array having a base connector adapted to be inserted into existing light sockets. Lighting elements are rotatably mounted on an edge of a baseboard to enable screwing the base connectors into existing light sockets while the baseboard is kept stationary. However, as best seen in FIG. 5 of the patent, a lower strip conductor 48 contacts an upper surface 94 of a contact 56 to provide one electrical connection (the other being by electrical contact point 76). Rotation of a thumb wheel 56 seats the assembly in a light socket. Since lower strip conductor 48 is not attached to upper contact 94, the assembly is free to rotate by operation of thumb wheel 56. However, in corrosive environments, the electrical contact between lower strip conductor 48 and upper surface 94 of contact 56 can be compromised since there is not a permanent connection.

SUMMARY OF THE INVENTION

The present invention is directed to a multi-layer LED assembly which is used as a replacement light for equipment used in manufacturing environments. On each layer of the multi-layer assembly, there are multiple LEDs which are mounted perpendicular to a base. The base is used to provide electrical and mechanical connection to a socket. The LED assembly is constructed in a manner which allows the LED assembly to be inserted into a socket of a lighting fixture and then mechanical and electrical connection is provided without requiring rotation of the LED assembly. Electrical connection is by permanently attached wires between the base and the LEDs. The base is rotatable within a predetermined angular range which is sufficient to provide a proper mechanical and electrical connection without putting strain on the permanently attached electrical wires. The LED assembly may utilize multiple layers of LEDs, with each layer itself having multiple LEDs.

The LEDs in each layer are mounted in a direction perpendicular to the base which results in light emanating in a direction perpendicular to the base instead of in a direction parallel to the base as is usually the case.

DETAILED DESCRIPTION OF THE INVENTION

Figure 1:
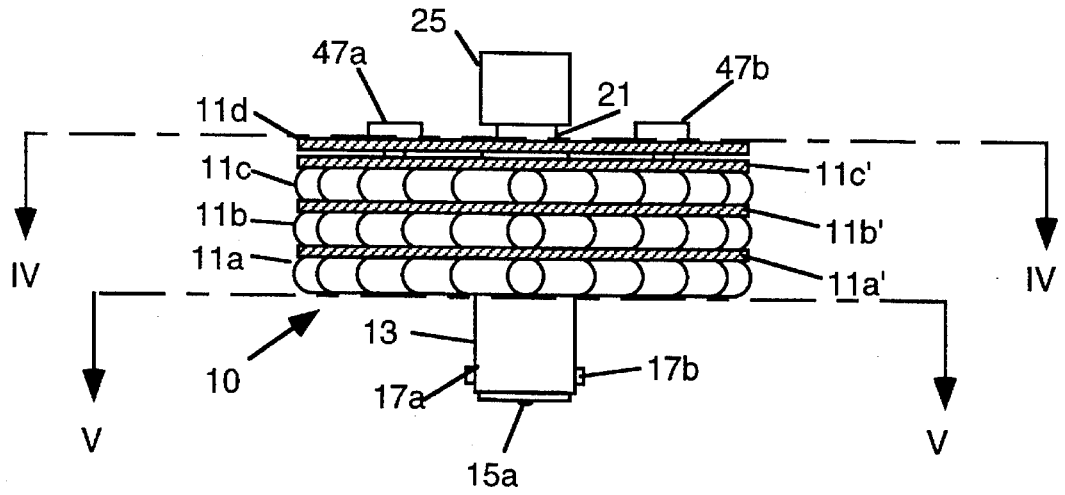
FIG. 1 is side elevation view of a multilayer LED assembly according to the present invention.

Referring now to FIG. 1, a side elevation view of a multilayer LED assembly 10, according to the present invention is shown. As shown in FIG. 1, there are three layers of LEDs **11*a*, 11*b* and 11*c*. Each LED in each layer 11*a*, 11*b* and 11*c* is electrically coupled to a printed circuit board 11*a*', 11*b*' and 11*c*' respectively. The number of LEDs in each layer is not critical to the implementation or use of the invention, and the number of layers may be more or less than the three shown in FIG. 1, depending upon how much light output is required. The assembly 10 also includes base 13, electrical contact 15*a* and 15*b* (only contact 15*a* showing in FIG. 1), and connection pins 17*a* and 17*b* for making a mechanical connection to a socket (not shown). Base 13** may have a different structure as necessary to fit into an existing socket. For example, some sockets only have a single contact in which case the base would have only one electrical contact usually centered on the bottom of the base or the connection pins may be oriented differently to match engaging slots on the socket. The base may be of any size as needed to match the socket into which it is to be inserted. The only requirement for practicing the invention is that the base rotate so as to engage the socket.

Figure 2:
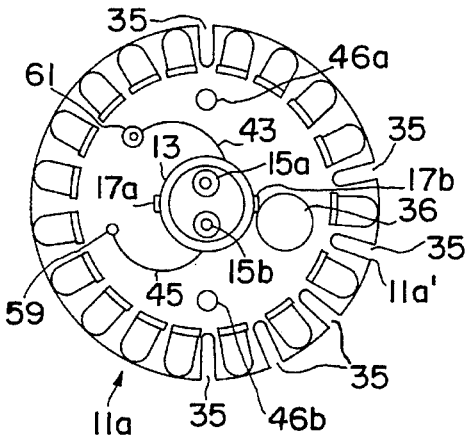
FIG. 2 is a bottom plan view of the multilayer LED assembly shown in FIG. 1.

FIG. 2 is a view of the invented LED assembly from the bottom showing the bottom layer of LEDs **11*a*, base 13 with electrical contacts 15*a* and 15*b*. Connection pins 17*a* and 17*b* extend from the base and are used to make mechanical connection with a socket into which the LED assembly 10 is installed. Also shown in FIG. 2 is the bottom surface of printed circuit board 11*a*' including notches 35, hole 36, wires 43 and 45 and hole 61 which are described below with reference to FIGS. 4 and 5**.

Figure 3:
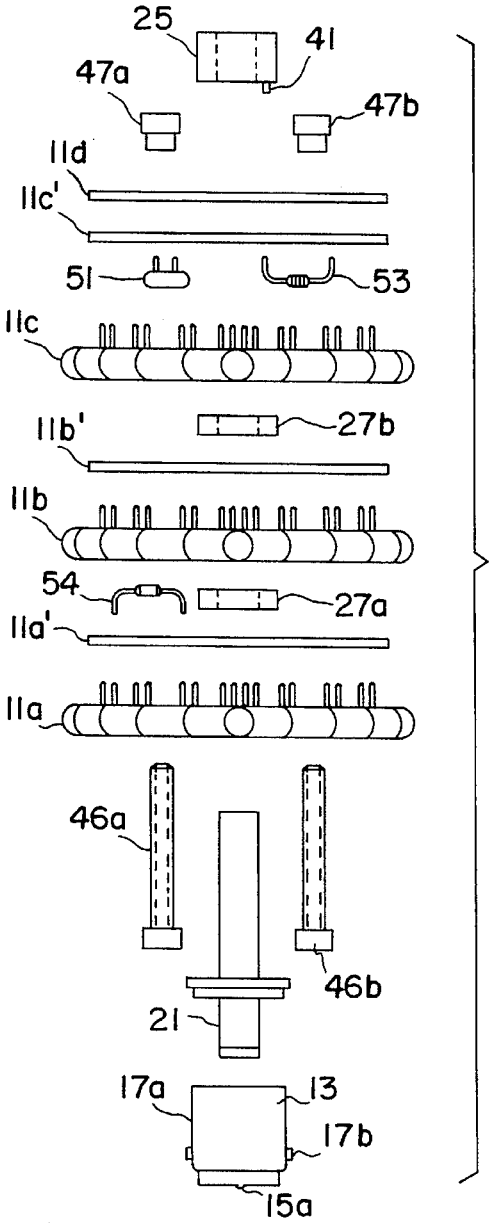
FIG. 3 is an exploded view of the multilayer LED assembly shown in FIG. 1.

Referring now to FIG. 3 which is an exploded view of LED assembly 10, base 13 is coupled to a center axle 21. Center axle 21 extends through the LED layers **11*a*, 11*b* and 11*c* and printed circuit boards 11*a*', 11*b*' and 11*c*' and is coupled to knob 25. After assembly, knob 25 is bonded to one end of center axle 21 and base 13 is bonded to the other end of center axle 21 so that rotation of knob 25 causes a corresponding rotation of base 13. Spacers 27*a* and 27*b* are disposed between the printed circuit board layers such that spacer 27*a* is disposed between printed circuit boards 11*a*' and 11*b*' and spacer 27*b* is disposed between printed circuit boards 11*b*' and 11*c*'. Center axle 21 also passes through spacers 27*a* and 27*b*. Base 13 and knob 25 are aligned to each other and pass through a center line through LED layers 11*a*, 11*b*, and 11*c* and printed circuit boards 11*a*', 11*b*' and 11*c*'. Center axle 21 is dimensioned so that its circumference is slightly less than the circumference of through holes 37 in boards 11*a*', 11*b*', 11*c* and insulating layer 11*d* so that there is a friction fit between axle 21** and the printed circuit board layers and insulating layer.

As previously noted, the LEDs are installed on the printed circuit boards 11*a'*, 11*b'*, and 11*c'*. After installation, as best seen in FIG. 3, the leads are bent so that the LEDs are arranged at an angle of 90°in a direction away from base 13. FIG. 3 also shows bolts 46*a* and 46*b*, nuts 47*a* and 47*b*, capacitor 51, resistor 53. Screws 46*a* and 46*b* and lock nuts 47*a* and 47*b* are used to ensure that insulating layer 11*d*, and printed circuit boards 11*a'*, 11*b'* and 11*c'* do not rotate with respect to each other after assembly. Bolts 46*a* and 46*b* pass through holes in printed circuit boards 11*a'*, 11*b'*, 11*c'* and insulating layer 11*d*. The diameters of the holes into which the bolts 46*a* and 46*b* pass are just slightly larger than the bolts so that once lock nuts 47*a* and 47*b* are fixed to bolts 46*a* and 46*b*, all of the layers are in a fixed relationship. Capacitor 51, resistor 53 and diode 54 are used to control current flow and size as is well known in the art. Of course, other current limiting and controlling mechanisms may be employed without departing from the invention.

Figure 4:
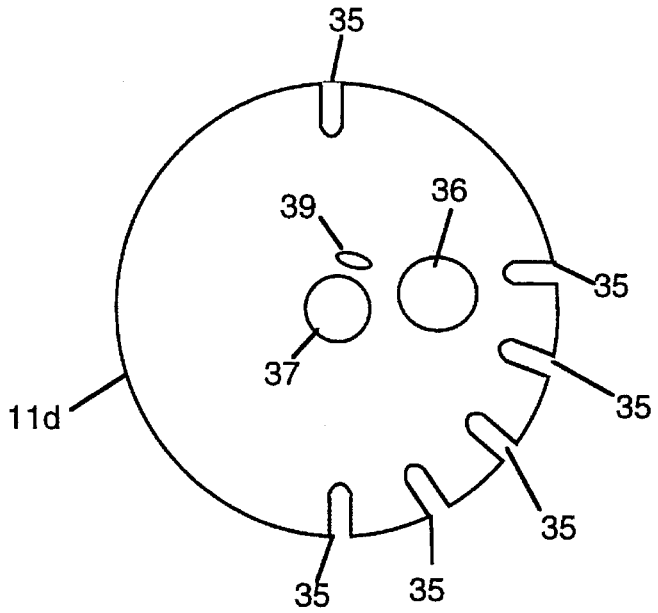
FIG. 4 is a top sectional view of insulating layer **11*d* taken along line IV—IV of FIG. 1**.

FIG. 4 illustrates insulating layer 11*d* with notches 35, center hole 37 through which passes center axle 21 and notch 39. In this connection, it should be noted that knob 25 (see FIG. 3), includes a pin 41 extending from its bottom surface. Pin 41 engages slot 39 on insulating layer 11*d*. The dimensions of slot 39 are set such that knob 25 can be rotated to an angle sufficient to enable base 13 to engage a socket into which it is inserted, but not so far as to put tension onto wires 43 and 45 shown in FIG. 2. Insulating layer 11*d* is provided to protect the electrical contacts on the topmost LED layer from being contacted by metallic surfaces such as a panel in which the assembly is installed.

In this connection, wires 43 and 45 are electrically conductive wires, one of which passes through base 13 and is in electrical contact with one of contacts 15*a* and 15*b* at one end and a lead of an LED, preferably on printed circuit board 11*a'* at the other end. The other of wires 43 and 45 passes through base 13 and is in electrical contact with the other of contacts 15*a* and 15*b*, the other end of which is in electrical contact with a lead of an LED, preferably on printed circuit board 11*c'*. For example, assuming that each LED in a particular layer has its leads connected in a series relationship excepting for a first LED and a last LED, by connecting for example wire 43 to one of the open leads and connecting the other open lead of that LED to an open lead on an LED in the second layer and the other open lead of an LED in the second layer to one open lead of an LED in the third layer, by connecting wire 45 to the other open lead in the third layer, a series electrical connection exists among all of the LEDs and wires 43 and 45.

Figure 5:
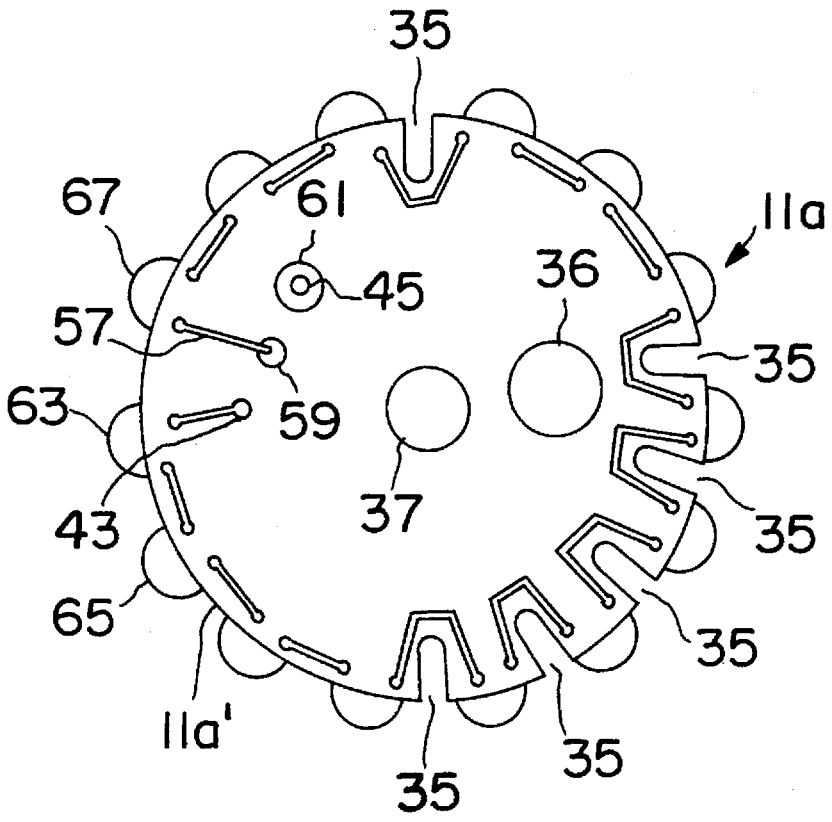
FIG. 5 is a sectional view taken along line V—V of FIG. 1 showing the top side of printed circuit board **11*a*'**.

This is illustrated by way of example in FIG. 5 where wire 43 is shown connected to one lead of LED 63 in LED layer 11*a*. The other lead of LED 51 is connected in series to adjacent LED 65, which in turn is connected to its adjacent LED. One lead of LED 67 is connected to a wire 57 which passes through hole 59 to the second LED layer and is connected to one lead of an LED on the second layer. Wire 45 passes through hole 61 and through a corresponding hole in printed circuit board 11*b'*and is coupled to one lead of an LED on the third layer. In this manner a complete circuit is formed so that the LEDs in each layer are connected in a series relationship and are electrically connected to contacts 15*a* and 15*b* so that when appropriate power is applied to contacts 15*a* and 15*b*, all the LEDs in each layer become lit. Of course, the LEDs may be connected in parallel or in any combination of series and parallel connections in any desired manner to provide a desired lighting effect and/or to meet input voltage requirements without departing from the present invention.

Wires 43 and 45 are provided with enough slack so that rotation of base 13 by turning knob 25 does not stretch either wire to its limit. Knob 25 may be turned by hand or it may have a slot on its top that it may be turned by a screw driver. Of course, wires 43 and 45 should be kept as short as possible to avoid problems during installation or to otherwise avoid crimping of the wires when knob 25 is turned.

In this manner, a light assembly can be constructed which can be installed into an existing socket without requiring turning of the entire light assembly. Rather, the light assembly can be put into the socket without any twisting at all, and once base 13 is inserted into the socket, knob 25 is rotated until pins 17*a* and 17*b* engage retaining slots within the socket.

Notches 35 and hole 36 are made in each of insulating layer 11*d* and printed circuit boards 11*a'*, 11*b'* and 11*c'*. The holes in the four layers and the notches in the four layers are aligned with each other during assembly and fit into corresponding protrusions of the socket assembly into which the light assembly is to be inserted. The notches and holes prevent the light assembly from turning when knob 25 is rotated to cause base 13 to engage the socket. The particular arrangement of notches and holes shown in the Figures is for illustration only. In other embodiments there need only be a single hole or a single notch or other structure, the only requirement being that the hole or notch or other structure be arranged in a manner which prevents rotation of the LED layers when knob 25 is rotated.

We claim:

1. An assembly for insertion into a socket, said assembly having at least one layer of LEDs mounted on at least one board, said assembly comprising:

a) a base adapted to be installed in the socket by rotation of the base;

b) an axle coupled to said base which passes through said at least one board onto which is mounted a layer of LEDs;

c) an insulating layer including a hole through which said axle passes and a slot;

d) a knob coupled to said axle at an end opposite said base and adjacent to said insulating layer, said knob having a pin adapted to engage said slot and move back and forth within said slot as said knob is rotated clockwise and counter clockwise.

2. The assembly defined by claim 1 further comprising a first electrically conductive wire coupled to said base and a lead of one of said LEDs.

3. The assembly defined by claim 2 further comprising a second electrically conductive wire coupled to said base and a lead of one of said LEDs different from the lead to which said first electrically conductive wire is coupled.

4. The assembly defined by claim 3 wherein said slot is dimensioned so that the knob is rotatable to an angle sufficient to enable the base to engage the socket, but not so far as to put tension onto said first wire and said second wire.

5. The assembly defined by claim 4 further comprising means for preventing said LED layers and said insulating layer from rotating when said knob is rotated.

6. The assembly defined by claim 5 wherein said prevention means is at least one notch disposed at an edge of each of said LED layers and said insulating layer and a hole through each of said LED layers and said insulating layer.

7. The assembly defined by claim 3 further comprising means for preventing said LED layers and said insulating layer from rotating when said knob is rotated.

8. The assembly defined by claim 7 wherein said prevention means is at least one notch disposed at an edge of each of said LED layers and said insulating layer and a hole through each of said LED layers and said insulating layer.

9. The assembly defined by claim 2 wherein said slot is dimensioned so that the knob is rotatable to an angle sufficient to enable the base to engage the socket, but not so far as to put tension onto said first wire.

10. The assembly defined by claim 9 further comprising means for preventing said LED layers and said insulating layer from rotating when said knob is rotated.

11. The assembly defined by claim 10 wherein said prevention means is at least one notch disposed at an edge of each of said LED layers and said insulating layer and a hole through each of said LED layers and said insulating layer.

12. The assembly defined by claim 2 further comprising means for preventing said LED layers and said insulating layer from rotating when said knob is rotated.

13. The assembly defined by claim 12 wherein said prevention means is at least one notch disposed at an edge of each of said LED layers and said insulating layer and a hole through each of said LED layers and said insulating layer.

14. The assembly defined by claim 1 wherein said slot is dimensioned so that the knob is rotatable to an angle sufficient to enable the base to engage the socket, but not so far as to put tension onto at least one wire coupling at least one electrical contact on said base to at least one lead of one of said LEDs.

15. The assembly defined by claim 14 further comprising means for preventing said LED layers and said insulating layer from rotating when said knob is rotated.

16. The assembly defined by claim 15 wherein said prevention means is at least one notch disposed at an edge of each of said LED layers and said insulating layer and a hole through each of said LED layers and said insulating layer.

17. The assembly defined by claim 1 wherein each of said LEDs has a pair of leads which are bent so that its corresponding LED is facing a direction perpendicular to said axle.

18. The assembly defined by claim 1 further comprising means for preventing said LED layers and said insulating layer from rotating when said knob is rotated.

19. The assembly defined by claim 18 wherein said prevention means is at least one notch disposed at an edge of each of said LED layers and said insulating layer and a hole through each of said LED layers and said insulating layer.

* * * * *

UNITED STATES PATENT AND TRADEMARK OFFICE

CERTIFICATE OF CORRECTION

PATENT NO. : 5,577,832

DATED : November 26, 1996

INVENTOR(S) : Lodhie

It is certified that error appears in the above-identified patent and that said Letters Patent is hereby corrected as shown below:

In column 3 at line 51, please delete " 51 ' and insert -- 63 --.

Signed and Sealed this

Eleventh Day of November, 1997

*Attest:*

Bruce Lehman

BRUCE LEHMAN

*Attesting Officer*

*Commissioner of Patents and Trademarks*